US011038253B1

(12) United States Patent
Tseng

(10) Patent No.: US 11,038,253 B1
(45) Date of Patent: Jun. 15, 2021

(54) SATELLITE ANTENNA AZIMUTH ADJUSTMENT ASSEMBLY

(71) Applicant: JONSA TECHNOLOGIES CO., LTD., Nantou (TW)

(72) Inventor: Ying-Chieh Tseng, Nantou (TW)

(73) Assignee: Jonsa Technologies Co., Ltd., Nantou (TW)

( * ) Notice: Subject to any disclaimer, the term of this patent is extended or adjusted under 35 U.S.C. 154(b) by 0 days.

(21) Appl. No.: 16/822,532

(22) Filed: Mar. 18, 2020

(51) Int. Cl.
*H01Q 1/12* (2006.01)
*H01Q 1/28* (2006.01)

(52) U.S. Cl.
CPC ..... *H01Q 1/125* (2013.01); *H01Q 1/288* (2013.01)

(58) Field of Classification Search
CPC ..... H01Q 1/125; H01Q 1/288; H01Q 3/06
USPC ..... 343/700 R
See application file for complete search history.

(56) References Cited

U.S. PATENT DOCUMENTS 4,748,451 A * 5/1988 Edwards ..... H01Q 19/13 248/274.1
4,755,830 A * 7/1988 Plunk ..... H01Q 1/1221 248/514
5,870,059 A * 2/1999 Reynolds ..... H01Q 1/1242 343/760
6,268,826 B1 * 7/2001 Schmidt ..... H01Q 1/125 342/359
6,963,316 B1 * 11/2005 Lin ..... H01Q 1/1228 343/882
7,142,168 B1 * 11/2006 Sinclair ..... H01Q 1/12 343/882
10,608,316 B2 * 3/2020 Moheb ..... H01Q 15/14
2002/0083574 A1 * 7/2002 Matz ..... H01Q 1/1257 29/600
2002/0084396 A1 * 7/2002 Weaver ..... F16M 11/10 248/278.1
2005/0264467 A1 * 12/2005 Lin ..... H01Q 3/08 343/882
2007/0046553 A1 * 3/2007 Lin ..... H01Q 3/08 343/757
2007/0132655 A1 * 6/2007 Lin ..... H01Q 1/125 343/880
2007/0146229 A1 * 6/2007 Lin ..... H01Q 1/125 343/892
2007/0152124 A1 * 7/2007 Staney ..... F16M 11/10 248/371
2007/0210978 A1 * 9/2007 Zihlman ..... H01Q 1/125 343/892
2007/0216592 A1 * 9/2007 Park ..... H01Q 19/12 343/765

(Continued)

*Primary Examiner* — Lam T Mai
(74) *Attorney, Agent, or Firm* — Rosenberg, Klein & Lee

(57) ABSTRACT

A satellite antenna azimuth adjustment assembly has a base, an adjusting bracket, an adjustment component, and a support. The base has a top plate and a positioning opening. The adjusting bracket is connected to the top plate of the base at a rotatable angle and has a connecting hole at a position outside the top plate and a slide groove being an arced groove aligning with the positioning opening. The adjustment component is rotatably connected with the adjusting bracket and has an adjusting shaft mounted in the connecting hole of the adjusting bracket and a positioning head mounted in the slide groove and the positioning opening of the base. The support is pivotably connected with the adjusting bracket.

18 Claims, 7 Drawing Sheets

(56) References Cited

U.S. PATENT DOCUMENTS

| | | | | |
|---|---|---|---|---|
| 2010/0073256 | A1* | 3/2010 | Zihlman | H01Q 3/08 343/882 |
| 2011/0030015 | A1* | 2/2011 | King | H01Q 21/30 725/68 |
| 2011/0193764 | A1* | 8/2011 | Shen | H01Q 3/02 343/882 |

* cited by examiner

SATELLITE ANTENNA AZIMUTH ADJUSTMENT ASSEMBLY

BACKGROUND OF THE INVENTION

1. Field of the Invention

The present invention relates to a satellite antenna, and more particularly to a satellite antenna azimuth adjustment assembly.

2. Description of Related Art

In order to adjust a satellite antenna to a good receiving angle, an angle adjustment mount is connected between the satellite antenna and a stand for adjusting an elevation angle (a vertical angle) of the satellite antenna and an azimuth angle (a horizontal angle) of the satellite antenna. The angle adjustment mount substantially has a base, a support, and an adjusting bracket. The base is mounted on the stand. The support is mounted on a rear of the satellite antenna. The adjusting bracket is connected with the base and the support. The adjusting bracket and the support are connected with each other via an elevation angle adjustment mechanism, and the adjusting bracket and the base are connected with each other via an azimuth angle adjustment mechanism. Thus, an orientation angle between the satellite antenna and the stand can be adjusted for receiving good satellite signals.

The azimuth angle adjustment mechanism mounted between the base and the adjusting bracket substantially comprises a horizontal leadscrew unit connected with the base and the adjusting bracket. A relative length of the leadscrew unit connecting between the base and the adjusting bracket can be adjusted by rotating the leadscrew unit, whereby the adjusting bracket is pivoted at a horizontal angle relative to the base. However, an adjustment space of the leadscrew unit is limited because of the arrangement thereof.

To overcome the shortcomings, the present invention tends to provide a satellite antenna azimuth adjustment assembly to mitigate or obviate the aforementioned problems.

SUMMARY OF THE INVENTION

The main objective of the invention is to provide a satellite antenna azimuth adjustment assembly having simple structures. An azimuth angle of the satellite antenna can be adjusted easily by the satellite antenna azimuth adjustment assembly.

A satellite antenna azimuth adjustment assembly comprises a base, an adjusting bracket, an adjustment component, and a support. The base has a connecting mount, a top plate fixed on a top of the connecting mount, and a positioning opening formed through the top plate at a position near an edge of the top plate. The adjusting bracket is connected to the top plate of the base at a rotatable angle and has a bottom plate abutting the top plate of the base and connected with the top plate of the base by a vertical pivot disposed in the connecting mount and multiple fasteners disposed around the connecting mount, a connecting hole formed through the bottom plate of the adjusting bracket and disposed at a position outside the top plate of the base, a slide groove being an arced groove aligning with the positioning opening of the base, and two ears formed at opposite sides of the bottom plate. The adjustment component is rotatably connected with the adjusting bracket and has an adjusting shaft mounted in the connecting hole of the adjusting bracket and a positioning head spaced from the adjusting shaft at an interval and mounted in the slide groove of the adjusting bracket and the positioning opening of the base. The support is pivotably connected with the ears of the adjusting bracket at a front of the adjusting bracket.

Other objects, advantages and novel features of the invention will become more apparent from the following detailed description when taken in conjunction with the accompanying drawings.

DETAILED DESCRIPTION OF PREFERRED EMBODIMENT

Figure 1:
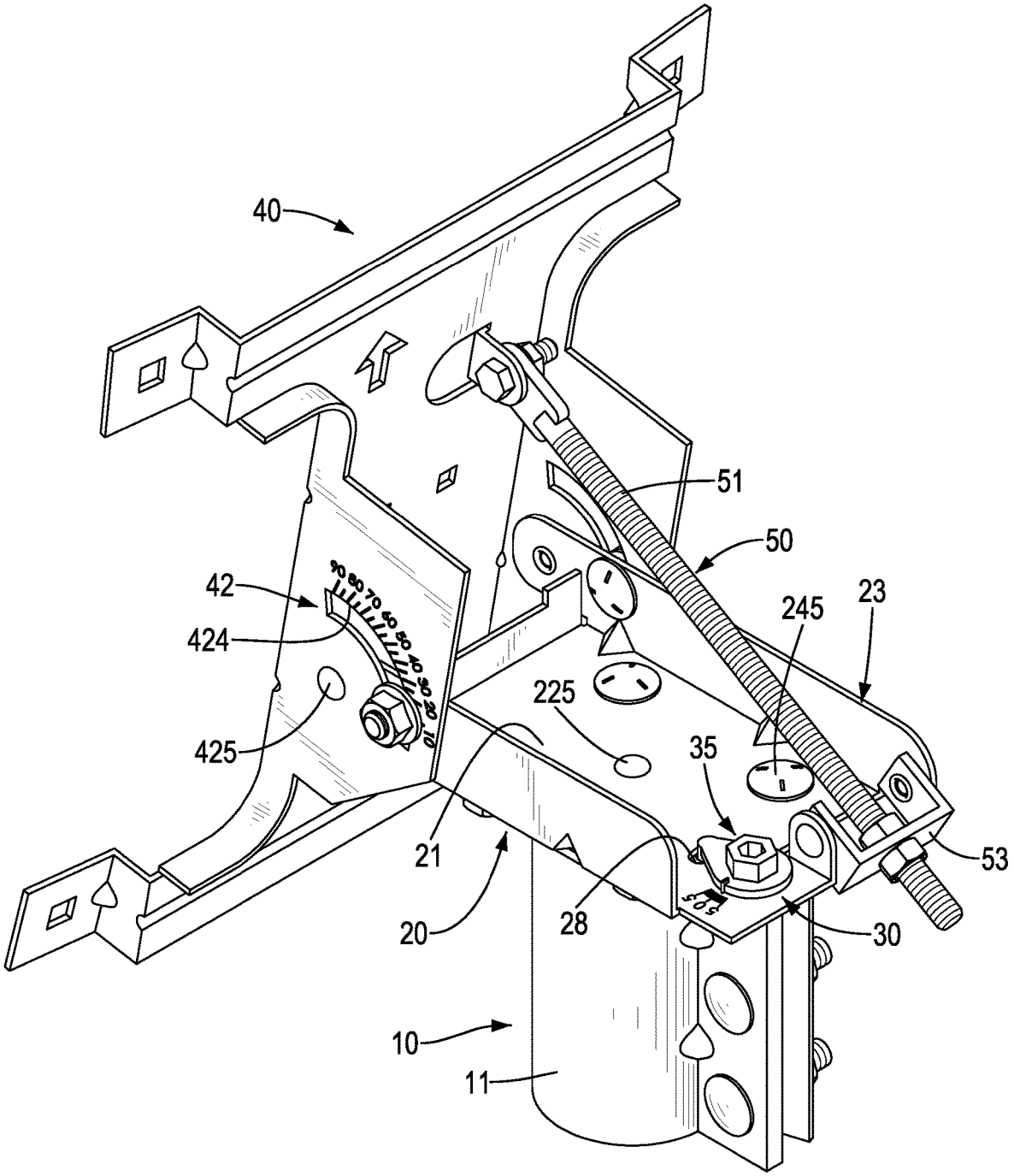
FIG. 1 is a perspective view of a satellite antenna azimuth adjustment assembly in accordance with the present invention.
Figure 2:
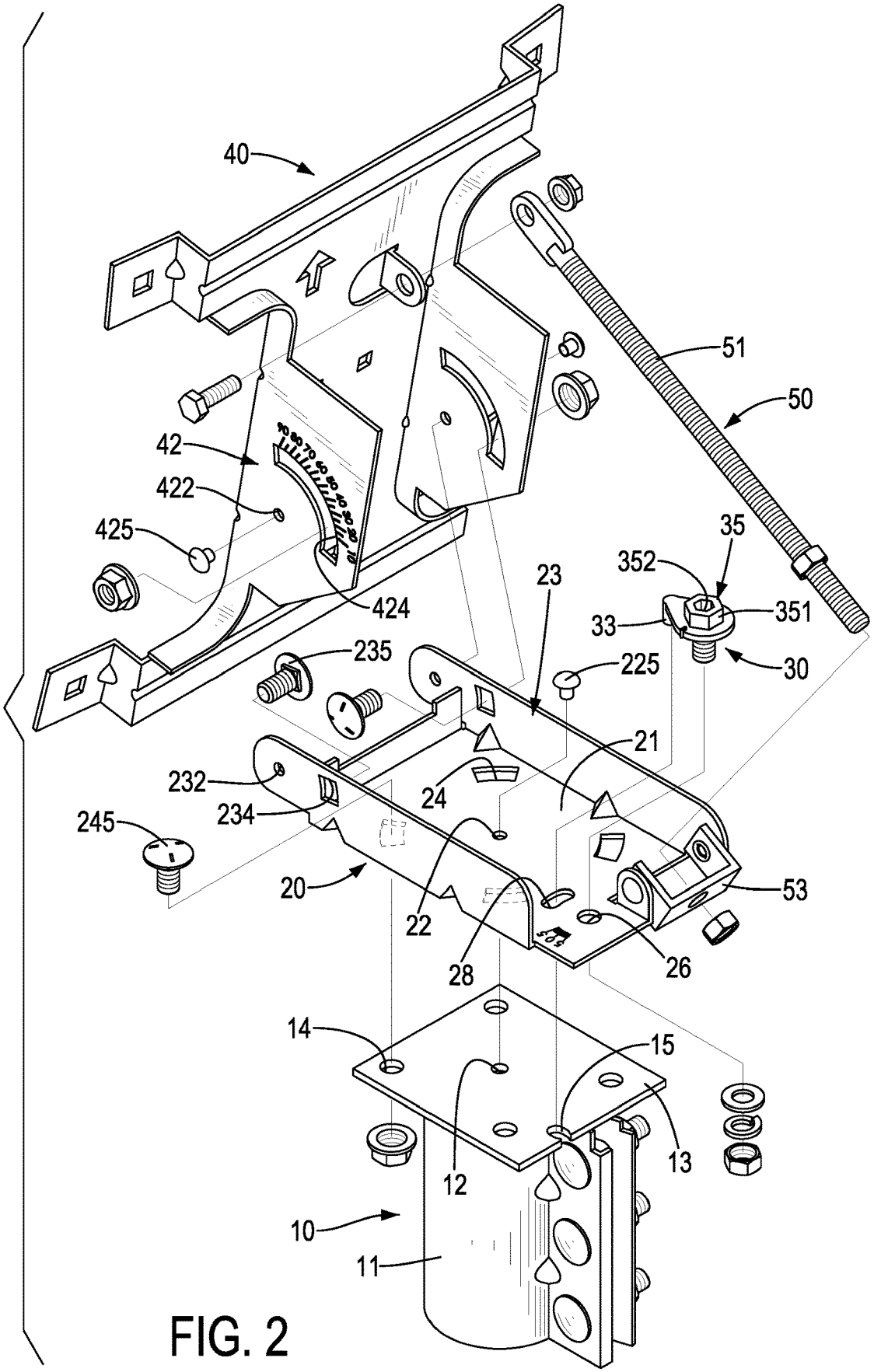
FIG. 2 is an exploded perspective view of the satellite antenna azimuth adjustment assembly in FIG. 1.

With reference to FIGS. 1 to 3, and 7, a satellite antenna azimuth adjustment assembly in accordance with the present invention has a base 10, an adjusting bracket 20, an adjustment component 30, and a support 40.

The base 10 is applied for mounting on a stand and has a connecting mount 11, a top plate 13, and a positioning opening 15. The connecting mount 11 is a C-shaped clamping tube and is applied for mounting and clamping the stand. The top plate 13 is rectangular in shape and is fixed on the top of the connecting mount 11 by welding. The positioning opening 15 is formed through the top plate 13 at a position near an edge of the top plate 13. The positioning opening 15 may be recessed in the edge of the top plate 13, or the positioning opening 15 is formed through the top plate 13 and transversely extends to the edge of the top plate 13 to form a side opening in the edge of the top plate 13.

The adjusting bracket 20 is connected to the top plate 13 of the base 10 at a rotatable angle and has a bottom plate 21, a connecting hole 26, a slide groove 28, and two ears 23.

The bottom plate 21 abuts the top plate 13 and is connected with the top plate 13 via a vertical pivot 225 disposed in the connecting mount 11 and multiple fasteners 245 disposed around the connecting mount 11. The top plate 13 has a base pivot opening 12 aligning with the vertical pivot 225 and formed through the top plate 13. The bottom plate 21 has a first pivot opening 22 aligning with the vertical pivot 225 and formed through the bottom plate 21. The vertical pivot 225 may be a rivet, is inserted in the first pivot opening 22 and the base pivot opening 12, and joints the base 10 and the adjusting bracket 20 by riveting. The top plate 13 and the bottom plate 21 respectively have multiple fastening openings 14 and multiple fastening arced grooves 24. The fastening openings 14 respectively surround the fasteners 245, and the fastening arced grooves 24 respectively align with the fastening openings 14 and respectively surround the fasteners 245. The vertical pivot 225 is located at the center of the surrounding fastening arced grooves 24. Each fastener 245 is mounted in the fastening opening 14 and the fastening arced groove 24. When the adjusting bracket 20 is pivoted at an angle relative to the base 10, the fastening arced groove 24 is moved relative to the fastener 245.

In the embodiment, the top plate 13 has four fastening openings 14 arranged around the base pivot opening 12 at angular intervals and disposed around the connecting mount 11. The bottom plate 21 has four fastening arced grooves 24 respectively aligning with the fastening openings 14. In another embodiment, the fastening openings 14 may be formed in the bottom plate 21 and the fastening arced grooves 24 may be formed in the top plate 13, or some of the fastening openings 14 are formed in the top plate 13 and the others are formed in the bottom plate 21, and the fastening arced grooves 24 are respectively formed in the bottom plate 21 and the top plate 13 and respectively align with the fastening openings 14. Each fastener 245 may be a pair of a square-neck bolt and a nut. A square-neck portion of each square-neck bolt may be engaged with the fastening arced groove 24 or the fastening opening 14 to prevent the bolt from rotating while fastening.

When adjusting a relative horizontal angle between the base 10 and the adjusting bracket 20, the fasteners 245 are slightly loosened to rotate the adjusting bracket 20 relative to the base 10. After adjusted, the fasteners 245 are fastened to prevent the adjusting bracket 20 from rotating relative to the base 10 after positioning.

The connecting hole 26 is formed through the bottom plate 21 of the adjusting bracket 20 at a position outside the top plate 13 of the base 10 and near the positioning opening 15. The slide groove 28 is an arced groove aligning with the positioning opening 15. The adjustment component 30 is rotatably connected with the adjusting bracket 20 and has an adjusting shaft 35 and a positioning head 33. The adjusting shaft 35 is mounted in the connecting hole 26. The positioning head 33 is spaced from the adjusting shaft 35 at an interval and is mounted in the slide groove 28 and the positioning opening 15. The adjusting shaft 35 has a head 351 formed on an end of the adjusting shaft 35 and is connected with a nut opposite the head 351. The head 351 abuts on the top of the bottom plate 21. The nut is disposed at the bottom of the bottom plate 21, and a spring washer and a flat washer may be disposed between the nut and the bottom plate 21. The head 351 may have an adjusting recess 352 recessed in the end of the head 351. The adjusting recess 352 may be a hexagon socket or a hexalobular socket, and a hexagon wrench or a hexalobular wrench can be inserted in the adjusting recess 352 to rotate the adjusting shaft 35 to drive the positioning head 33 to relatively slide along the slide groove 28. The head 351 may be a hexagon head. The adjustment component 30 may be disposed near the rear of the bottom plate 21 of the adjusting bracket 20. The bottom plate 21 may have a segment protruding from the rear edge of the top plate 13, which does not cover the top plate 13, and the connecting hole 26 is formed in the segment.

The two ears 23 are formed at opposite sides of the bottom plate 21 by bending from the bottom plate 21. The two ears 23 may be bent upwardly from the opposite sides of the bottom plate 21. The support 40 is pivotably connected with the ears 23 at the front of the adjusting bracket 20. The support 40 has two connecting arms 42 respectively abutting the ears 23, each connecting arm 42 is connected with the ear 23 abutting the connecting arm 42 by a horizontal pivot 425 mounted through the connecting arm 42 and the ear 23. The ears 23 each have a respective second pivot opening 232, the second pivot openings 232 of the ears 23 aligning with each other and formed through the ears 23 at positions near the front of the bottom plate 21. The connecting arms 42 each have a respective support pivot opening 422, the support pivot openings 422 of the connecting arms 42 aligning with the second pivot openings 232. The connecting arms 42 are respectively connected with the ears 23 by a horizontal pivot 425 mounted in the second pivot opening 232 and the support pivot opening 422. The ears 23 may each have a respective fixing hole 234. The connecting arms 42 may each have a respective fixing arced groove 424 being an arced groove, the horizontal pivot 425 is located at the center of the surrounding fixing arced grooves 424, and the fixing arced grooves 424 align with the fixing holes 234. A fastening component 235 is mounted in the fixing hole 234 of the ear 23 and the fixing arced groove 424 of the connecting arm 42 abutting the ear 23 for fastening the support 40 and the adjusting bracket 20 after adjusting a vertical angle of the support 40 relative to the adjusting bracket 20.

Figure 5:
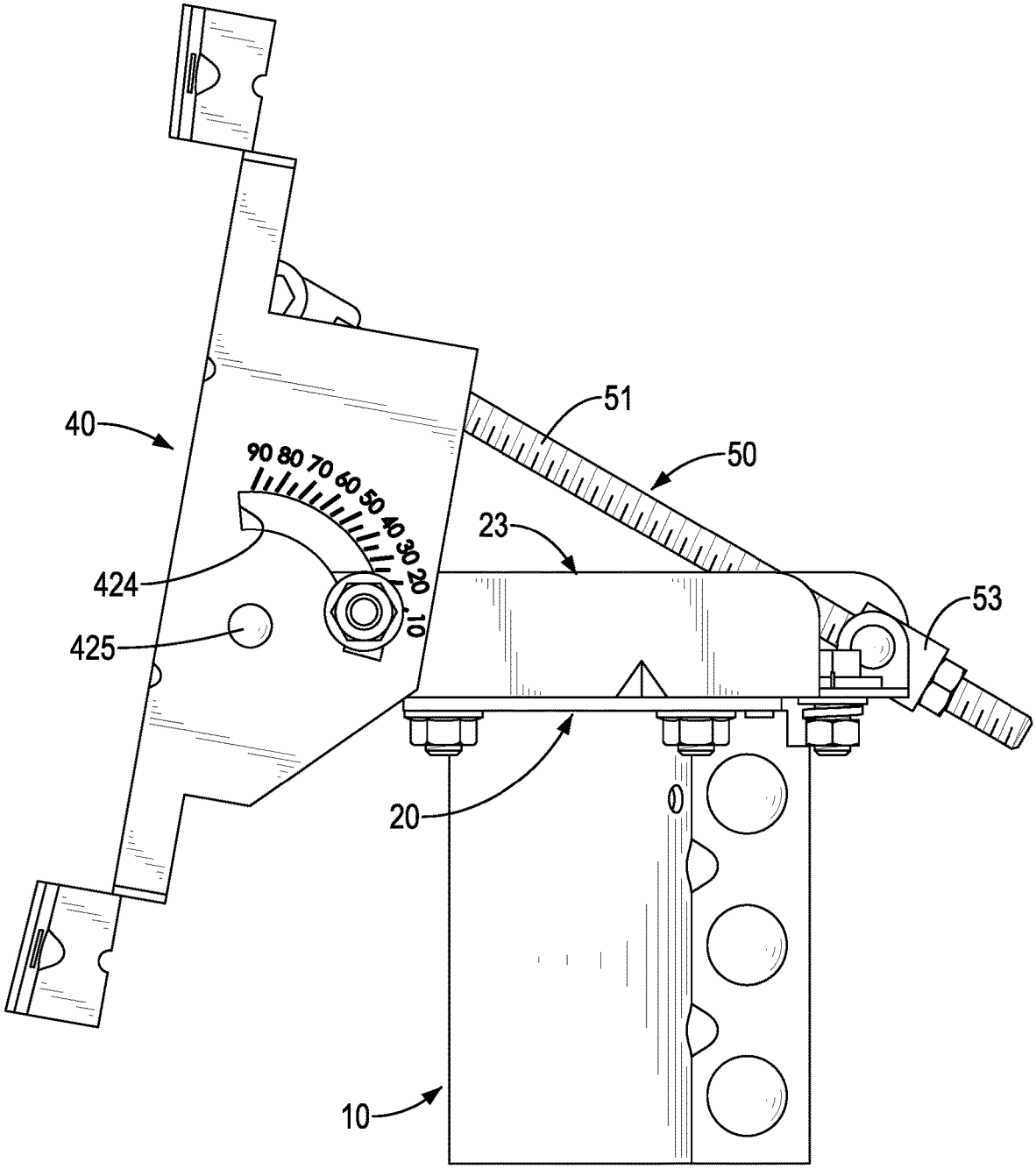
FIG. 5 is a side view of the satellite antenna azimuth adjustment assembly in FIG. 1.
Figure 6:
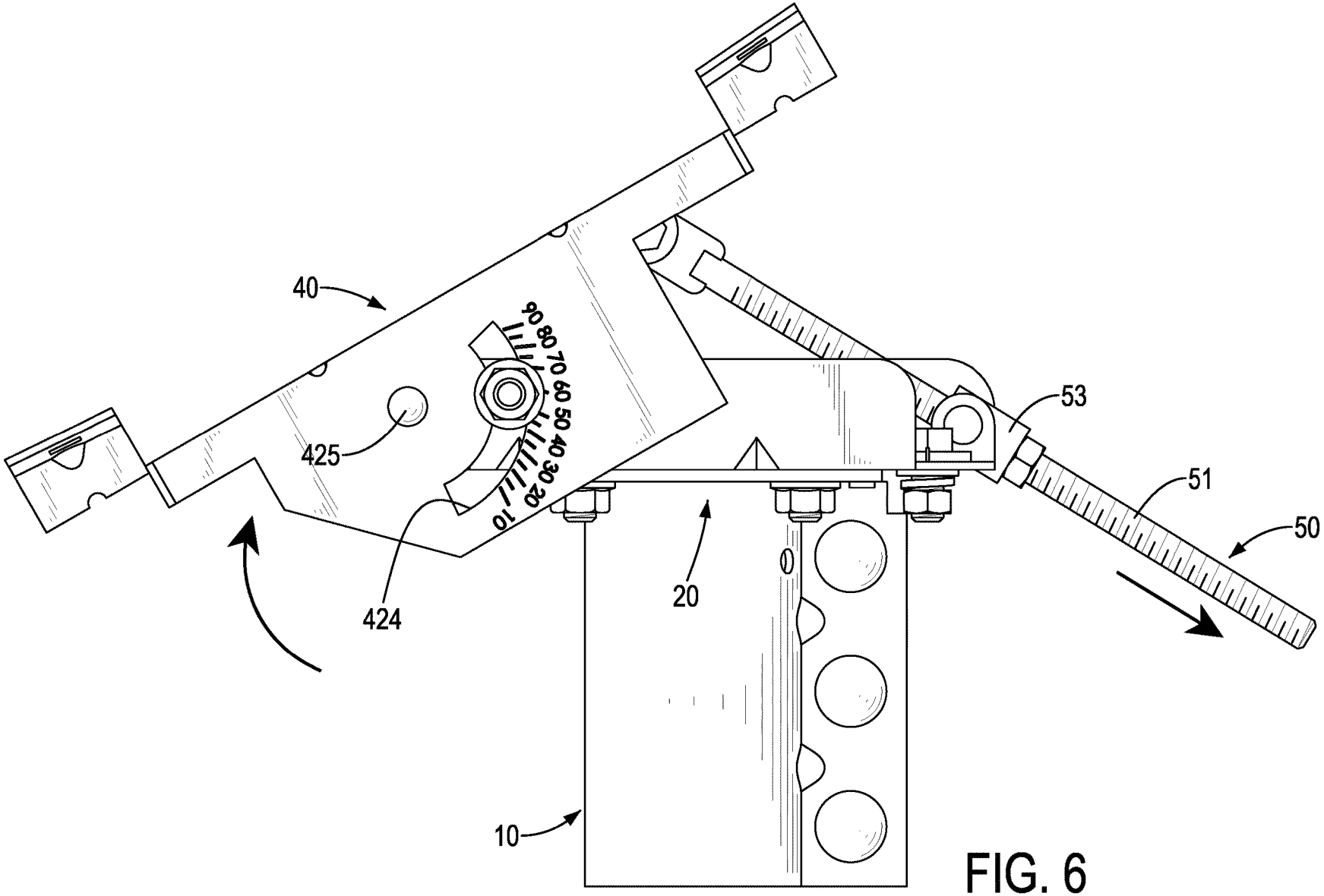
FIG. 6 is an operational side view of the satellite antenna azimuth adjustment assembly in FIG. 5 showing that a vertical angle is being adjusted.
Figure 7:
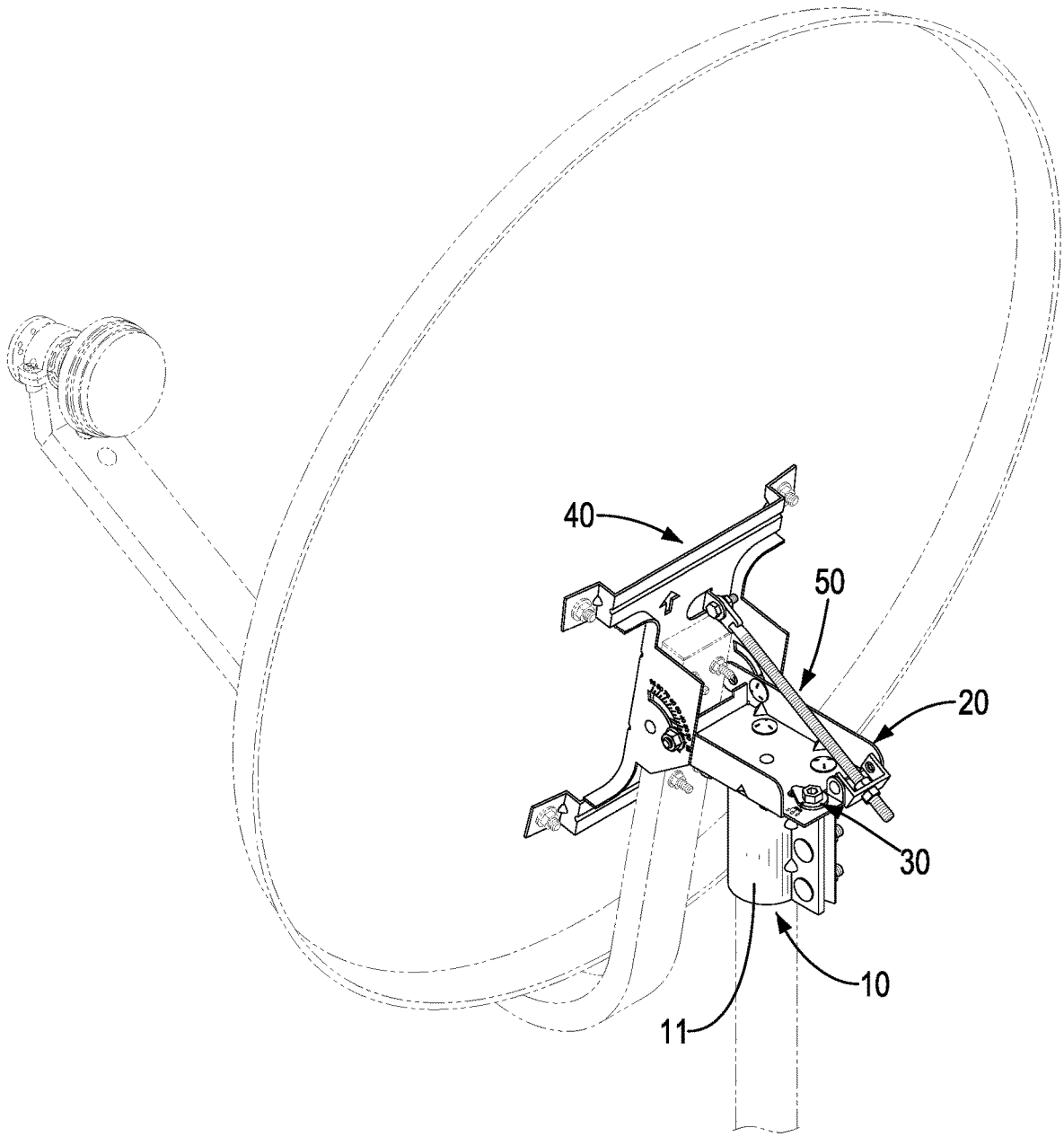
FIG. 7 is an operational perspective view of the satellite antenna azimuth adjustment assembly in FIG. 1 connected with an antenna and a stand.

The support 40 and the adjusting bracket 20 may be connected with a lead screw unit 50. The lead screw unit 50 has a threaded rod 51 and a rod seat 53. The rod seat 53 is pivotally connected with the adjusting bracket 20 at the rear of the adjusting bracket 20. The threaded rod 51 is mounted through and connected with the rod seat 53 and has an end connected with the support 40 at a position above the support pivot opening 422. With reference to FIGS. 5 and 6, a length of the threaded rod 51 connecting between the rod seat 53 and the support 40 is adjusted to drive the support 40 to pivot relative to the adjusting bracket 20.

Figure 3:
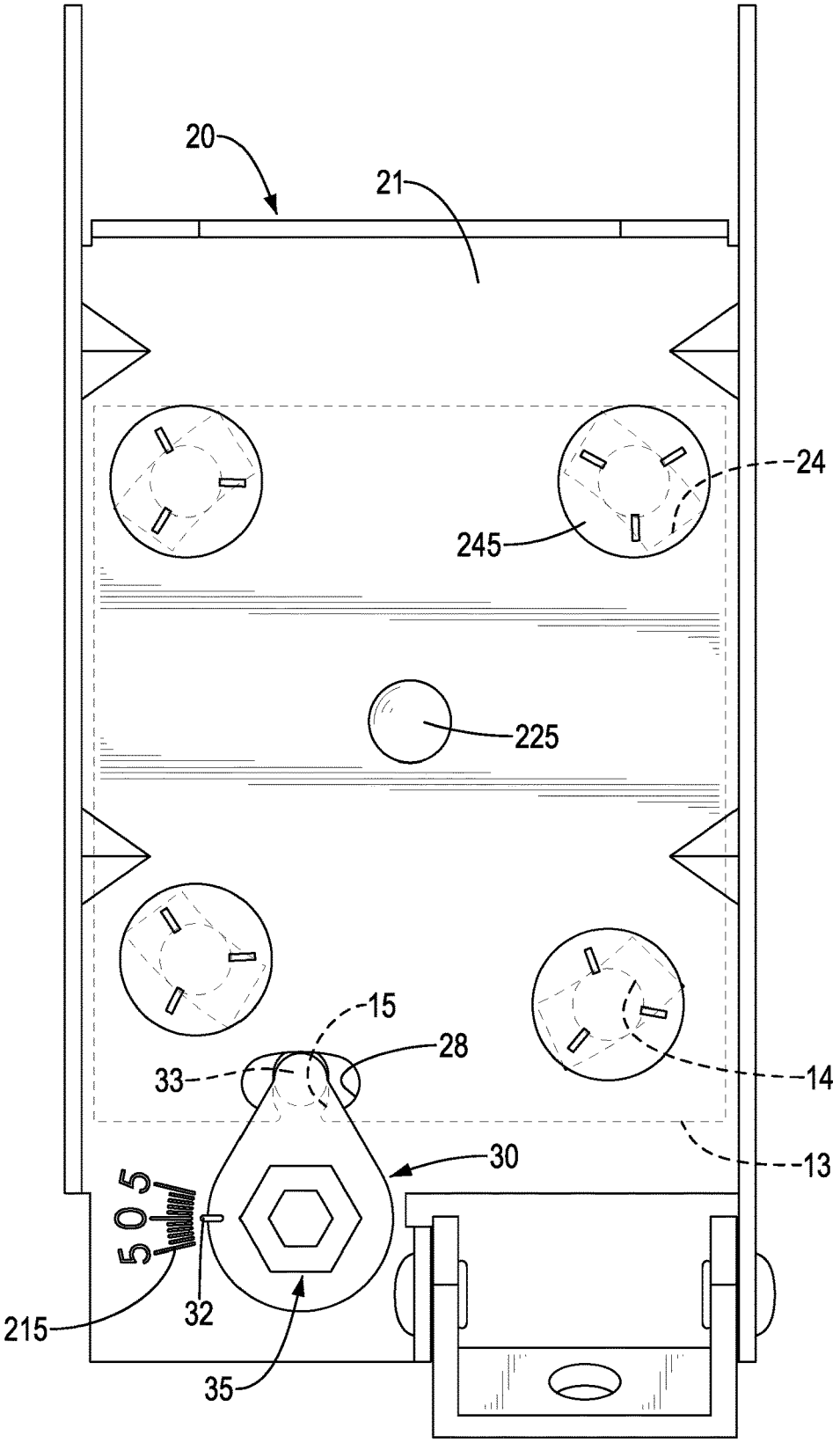
FIG. 3 is a top view of the satellite antenna azimuth adjustment assembly in FIG. 1, wherein the support thereof is omitted.
Figure 4:
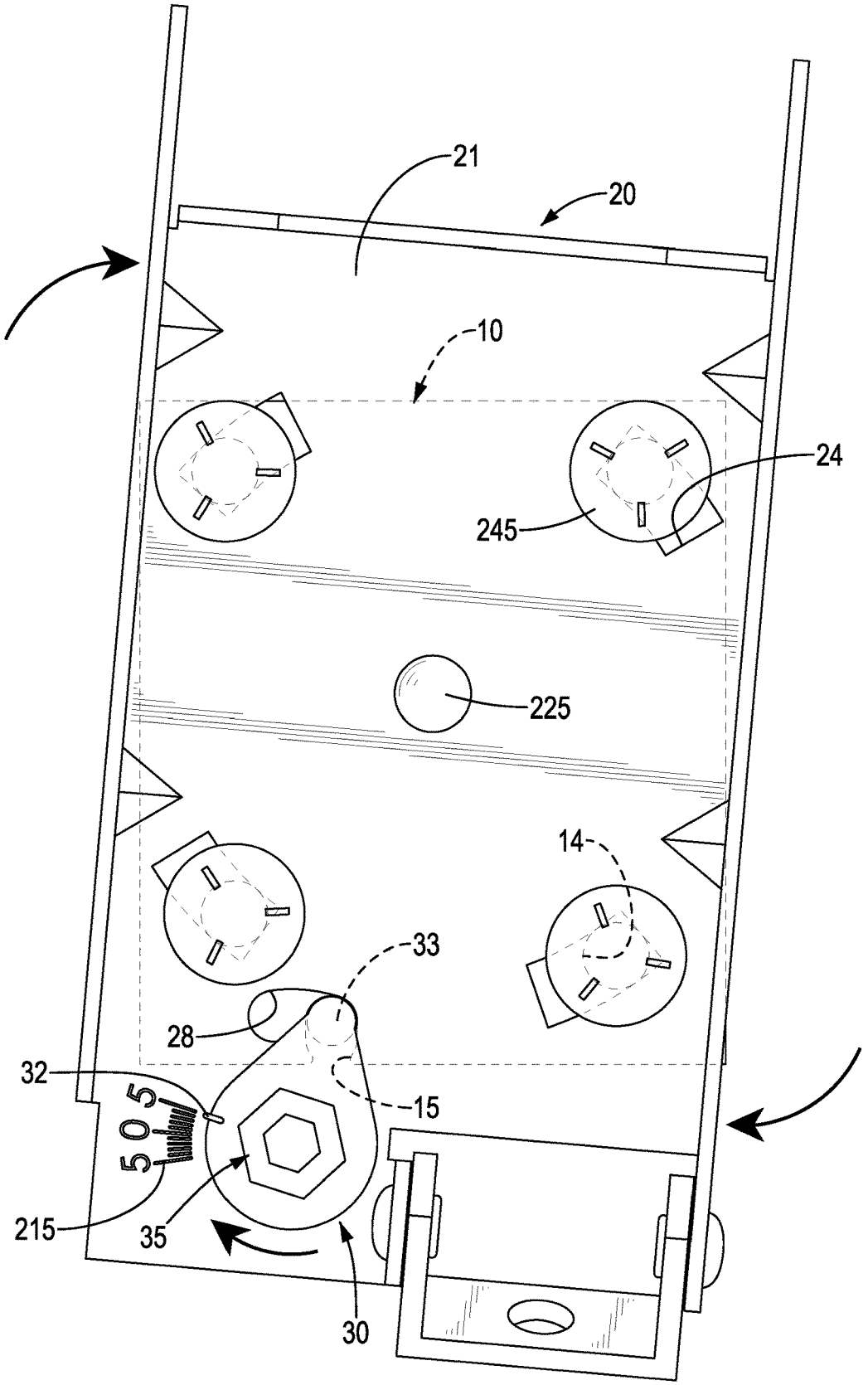
FIG. 4 is an operational top view of the satellite antenna azimuth adjustment assembly in FIG. 3 showing that a horizontal angle is being adjusted.

With reference to FIGS. 3 and 4, when rotating the adjusting shaft 35, the positioning head 33 is moved relative to the slide groove 28 of the adjusting bracket 20. Because the position of the positioning opening 15 of the base 10 is fixed, the adjusting shaft 35 of the adjustment component 30 will be moved relative to the positioning opening 15 to drive the adjusting bracket 20 being rotated relative to the base 10. Thus, the azimuth angle of the satellite antenna is adjusted. After adjusted, the position the adjusting bracket 20 is secured by fastening the fasteners 245. Preferably, the adjustment component 30 has a pointer 32 and the bottom plate 21 has scale marks 215 at corresponding angular positions for indication of the adjusted angle.

With such arrangement, the base 10 and the adjustment component 30 are stacked and connected with the adjusting bracket 20, and the size of the adjustment component 30 is small, so that an adjustment space of the adjustment component 30 may not be limited by other components. The vertical pivot 225 jointing the base 10 and the adjusting bracket 20 may be directly defined in a center of the base 10 to prevent the gravity center of the satellite antenna being displaced relative to the stand while adjusting the azimuth angle of the satellite antenna. The satellite antenna azimuth adjustment assembly has simple structures and can be easily assembled. An azimuth angle of the satellite antenna can be adjusted easily by the satellite antenna azimuth adjustment assembly.

What is claimed is:

1. A satellite antenna azimuth adjustment assembly comprising:

a base having a connecting mount;

a top plate fixed on a top of the connecting mount; and a positioning opening formed through the top plate at a position near an edge of the top plate;

an adjusting bracket connected to the top plate of the base at a rotatable angle and having a bottom plate abutting the top plate of the base and connected with the top plate of the base by a vertical pivot disposed in the connecting mount and multiple fasteners disposed around the connecting mount;

a connecting hole formed through the bottom plate of the adjusting bracket and disposed at a position outside the top plate of the base;

a slide groove being an arced groove aligning with the positioning opening of the base; and two ears formed at opposite sides of the bottom plate;

an adjustment component rotatably connected with the adjusting bracket and having an adjusting shaft mounted in the connecting hole of the adjusting bracket; and a positioning head spaced from the adjusting shaft at an interval and mounted in the slide groove of the adjusting bracket and the positioning opening of the base; and a support pivotably connected with the ears of the adjusting bracket at a front of the adjusting bracket.

2. The satellite antenna azimuth adjustment assembly as claimed in claim 1, wherein the top plate of the base and the bottom plate of the adjusting bracket respectively have multiple fastening openings and multiple fastening arced grooves, the fastening openings respectively surround the fasteners, the fastening arced grooves respectively align with the fastening openings and respectively surround the fasteners.

3. The satellite antenna azimuth adjustment assembly as claimed in claim 2, wherein the adjusting shaft has a head formed on an end of the adjusting shaft and having an adjusting recess recessed in an end of the head, and the adjusting shaft is connected with a nut opposite the head.

4. The satellite antenna azimuth adjustment assembly as claimed in claim 3, wherein the adjustment component has a pointer and the bottom plate of the adjusting bracket has scale marks at angular positions.

5. The satellite antenna azimuth adjustment assembly as claimed in claim 4, wherein the ears of the adjusting bracket are bent upwardly from the opposite sides of the bottom plate of the adjusting bracket, and the support has two connecting arms respectively abutting the ears of the adjusting bracket, and each connecting arm is connected with the ear abutting the connecting arm by a horizontal pivot mounted through the connecting arm and the ear.

6. The satellite antenna azimuth adjustment assembly as claimed in claim 5, wherein each of the ears of the adjusting bracket has a fixing hole, each of the connecting arms of the support has a fixing arced groove, and a fastening component is mounted in the fixing hole of each of the ears and the fixing arced groove of the connecting arm abutting the ear.

7. The satellite antenna azimuth adjustment assembly as claimed in claim 1, wherein the support and the adjusting bracket are connected with a lead screw unit having a threaded rod and a rod seat, the rod seat is connected with the adjusting bracket at a rear of the adjusting bracket, and the threaded rod is connected with the rod seat and has an end connected with the support.

8. The satellite antenna azimuth adjustment assembly as claimed in claim 2, wherein the support and the adjusting bracket are connected with a lead screw unit having a threaded rod and a rod seat, the rod seat is connected with the adjusting bracket at a rear of the adjusting bracket, and the threaded rod is connected with the rod seat and has an end connected with the support.

9. The satellite antenna azimuth adjustment assembly as claimed in claim 3, wherein the support and the adjusting bracket are connected with a lead screw unit having a threaded rod and a rod seat, the rod seat is connected with the adjusting bracket at a rear of the adjusting bracket, and the threaded rod is connected with the rod seat and has an end connected with the support.

10. The satellite antenna azimuth adjustment assembly as claimed in claim 4, wherein the support and the adjusting bracket are connected with a lead screw unit having a threaded rod and a rod seat, the rod seat is connected with the adjusting bracket at a rear of the adjusting bracket, and the threaded rod is connected with the rod seat and has an end connected with the support.

11. The satellite antenna azimuth adjustment assembly as claimed in claim 5, wherein the support and the adjusting bracket are connected with a lead screw unit having a threaded rod and a rod seat, the rod seat is connected with the adjusting bracket at a rear of the adjusting bracket, and the threaded rod is connected with the rod seat and has an end connected with the support.

12. The satellite antenna azimuth adjustment assembly as claimed in claim 6, wherein the support and the adjusting bracket are connected with a lead screw unit having a threaded rod and a rod seat, the rod seat is connected with the adjusting bracket at a rear of the adjusting bracket, and the threaded rod is connected with the rod seat and has an end connected with the support.

13. The satellite antenna azimuth adjustment assembly as claimed in claim 7, wherein the adjustment component is disposed near the rear of the adjusting bracket, and the head of the adjusting shaft abuts on a top of the bottom plate of the adjusting bracket.

14. The satellite antenna azimuth adjustment assembly as claimed in claim 8, wherein the adjustment component is disposed near the rear of the adjusting bracket, and the head of the adjusting shaft abuts on a top of the bottom plate of the adjusting bracket.

15. The satellite antenna azimuth adjustment assembly as claimed in claim 9, wherein the adjustment component is disposed near the rear of the adjusting bracket, and the head of the adjusting shaft abuts on a top of the bottom plate of the adjusting bracket.

16. The satellite antenna azimuth adjustment assembly as claimed in claim 10, wherein the adjustment component is disposed near the rear of the adjusting bracket, and the head of the adjusting shaft abuts on a top of the bottom plate of the adjusting bracket.

17. The satellite antenna azimuth adjustment assembly as claimed in claim 11, wherein the adjustment component is disposed near the rear of the adjusting bracket, and the head of the adjusting shaft abuts on a top of the bottom plate of the adjusting bracket.

18. The satellite antenna azimuth adjustment assembly as claimed in claim 12, wherein the adjustment component is disposed near the rear of the adjusting bracket, and the head of the adjusting shaft abuts on a top of the bottom plate of the adjusting bracket.

* * * * *